US006073398A

United States Patent [19]

Williams

[11] Patent Number: 6,073,398

[45] Date of Patent: Jun. 13, 2000

[54] GUTTER COVER

[76] Inventor: Paul A. Williams, P.O. Box 1616, Fayetteville, N.C. 28302

[21] Appl. No.: 09/124,170

[22] Filed: Jul. 28, 1998

[51] Int. Cl.[7] ..... E04D 13/064

[52] U.S. Cl. ..... 52/12; 52/11

[58] Field of Search ..... 52/11, 12

[56] References Cited

U.S. PATENT DOCUMENTS

| | | | |
|---|---|---|---|
| 4,497,146 | 2/1985 | Demartini | 52/12 |
| 4,876,827 | 10/1989 | Williams | 52/12 |
| 5,305,562 | 4/1994 | Sapia | 52/12 |
| 5,495,694 | 3/1996 | Kuhns | 52/12 |
| 5,557,891 | 9/1996 | Albracht | 52/12 |
| 5,595,027 | 1/1997 | Vail | 52/12 |
| 5,911,659 | 6/1999 | Serano | 52/12 |

*Primary Examiner*—Carl D. Friedman
*Assistant Examiner*—Phi Dieu Tran A
*Attorney, Agent, or Firm*—Lynn E. Barber

[57] ABSTRACT

A cover for a rain gutter having a front side and cross-pieces. The cover is made from a plurality of single rectangular sheets of material and has a front area integrally connected to a back planar area. The front area has an elongated leg portion integral with and perpendicular to a lower horizontal strip of a curved front portion and extending vertically below the sheet at about a right angle to the lower horizontal portion. The elongated leg portion and the curved front portion extend the length of the sheet, except that the leg portion is partially cut to form feet for resting on the gutter cross-pieces. The feet are bent upward and forward from the leg portion so that when the cover is placed on the rain gutter, the feet hold the leg portion of the gutter cover back from the front side of the gutter so that a covered opening is formed over the gutter. This allows leaves and branches to be kept out of the gutter, but allows capillary flow of water over the curved front portion, through the covered opening, and into the gutter.

5 Claims, 3 Drawing Sheets

GUTTER COVER

BACKGROUND OF THE INVENTION

1. Field of the Invention

This invention relates to gutter covers mounted over conventional rain gutters on a building structure.

2. Description of the Related Art

Rain gutters are mounted on buildings to direct run-off from the roof to the ground after a rain. Because leaves and other debris that falls into rain gutters can clog the rain gutters and render them useless, a number of different types of covers have been designed to shield the gutters from some or all falling debris while still allowing rain water to enter the gutters and flow through them.

For example, many prior gutter covers are essentially a sheet of metal or plastic having various holes through which water can run but through which leaves cannot fit. The problem with holes is that they tend to become clogged requiring individual cleaning of each of the holes to allow drainage of water through the gutter cover into the gutter.

Other prior gutter covers use clips or other attachment devices. The GUTTA GARD™ (GuttaGard USA, Petersburg, Va.) uses small clips which come loose from wind and expansion and contraction. This allows the cover to become dislodged and ineffective. Another product uses metal strip clips every five feet on gutters. Because of these clips, there are streaks of black water marks at 5-foot intervals on the face of the gutter due to water running down the face of the gutter due to these strip clips.

It is therefore an object of the invention to provide a rain gutter cover that does not require a clip nor does it require holes to be formed in the cover surface for drainage of the water into the cutter.

Other objects and advantages will be more fully apparent from the following disclosure and appended claims.

SUMMARY OF THE INVENTION

The invention herein is a cover for a rain. The cover comprises a plurality of single rectangular sheets of material, each sheet having a front area integrally connected to a back planar area. The front area has an elongated leg portion integral with and perpendicular to a lower horizontal strip of a curved front portion and extending vertically below the sheet at about a right angle to the lower horizontal portion. The elongated leg portion and the curved front portion extend the length of the sheet, except that the leg portion is partially cut to form feet, at intervals corresponding to the intervals between the gutter hangers, spike or other internal cross-piece in the gutter. The feet are bent upward and forward from the leg portion so that when the cover is placed on the rain gutter, the feet hold the leg portion of the gutter cover back from the front side of the gutter so that a covered opening is formed over the gutter. This allows leaves and branches to be kept out of the gutter, but allows capillary flow of water over the curved front portion, through the covered opening, and into the gutter. The feet also provide a resting point for the gutter cover and prevent wind uplift problems.

Other objects and features of the inventions will be more fully apparent from the following disclosure and appended claims.

DETAILED DESCRIPTION OF THE INVENTION AND PREFERRED EMBODIMENTS THEREOF

The present invention is a cover for a rain gutter that has any type of cross-pieces as are known in the art. Such prior cross-pieces include various types of cross-braces that are generally placed across the gutter at regular intervals along the gutter, perpendicular to the length of the gutter and above the gutter cavity, and serve to strengthen the gutter.

Figure 1:
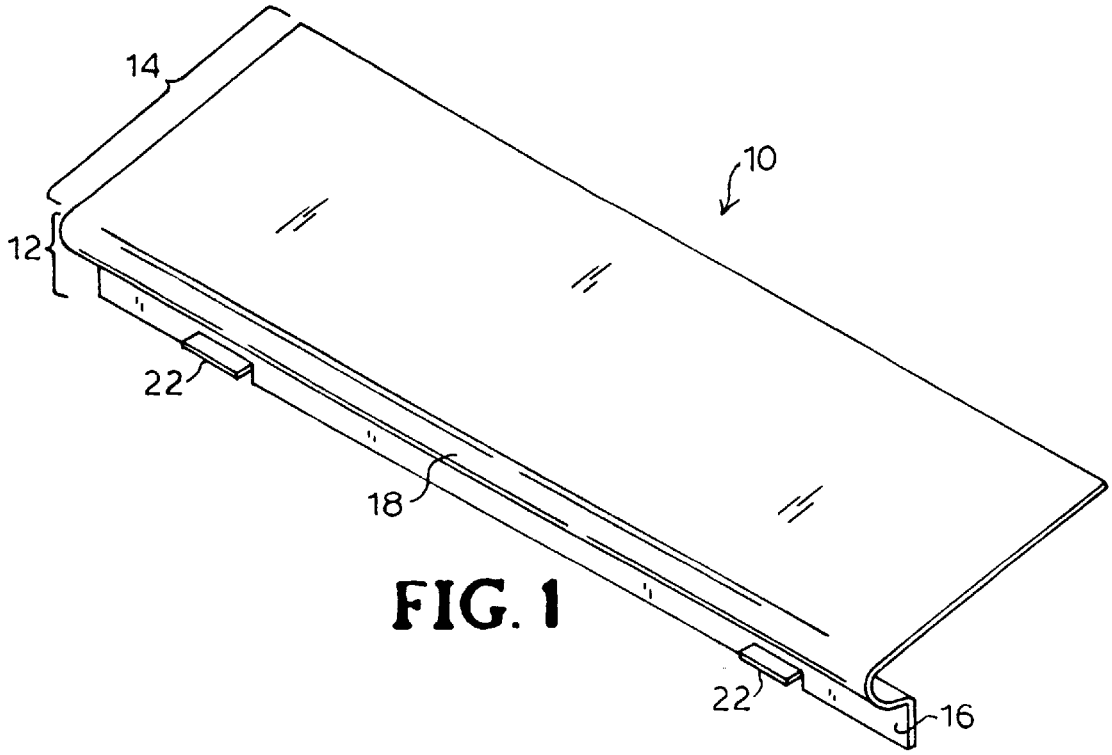
FIG. 1 is a perspective front view of a first embodiment of the gutter cover of the invention.

The cover 10 of the invention comprises a plurality of single rectangular sheets of material installable overlappingly adjacent to each other above a gutter, each of which sheets has a front area 12 integrally connected to a back planar area 14. Although the back planar area 14 can be a single plane as shown in FIG. 1, the back planar area can itself be in more than one plane. For example, in many types of roof structures where the slope is not flat or close to flat, the back planar area 14 is bent along a line 38 part of the way back at an angle A which may be anywhere from 0° (no bend) to 90° (right-angle bend). The embodiment shown in FIG. 2 has the back edge 36 of the back planar area 14 bent slightly upward. In this embodiment, when the gutter cover 10 is installed, the back planar area 14 is parallel to the roof-line and then levels out to be more horizontal immediately behind and at the front area 12.

Figure 2:
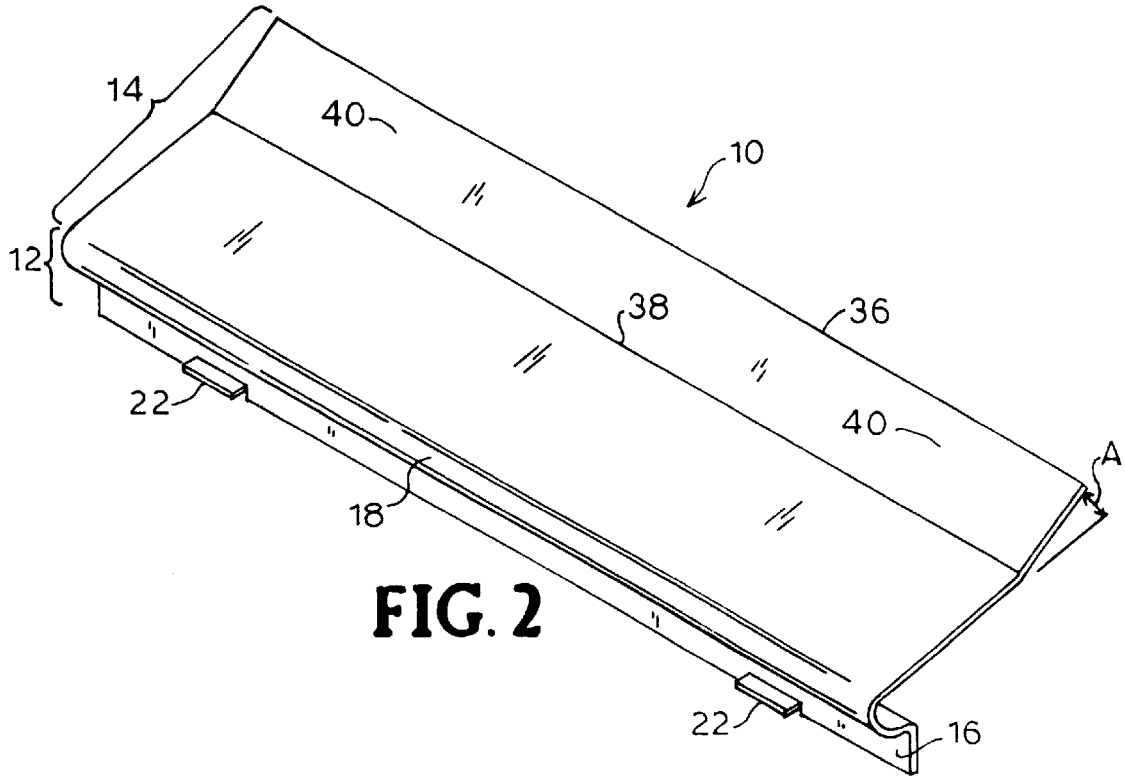
FIG. 2 is a perspective front view of a second embodiment of the gutter cover of the invention.
Figure 3:
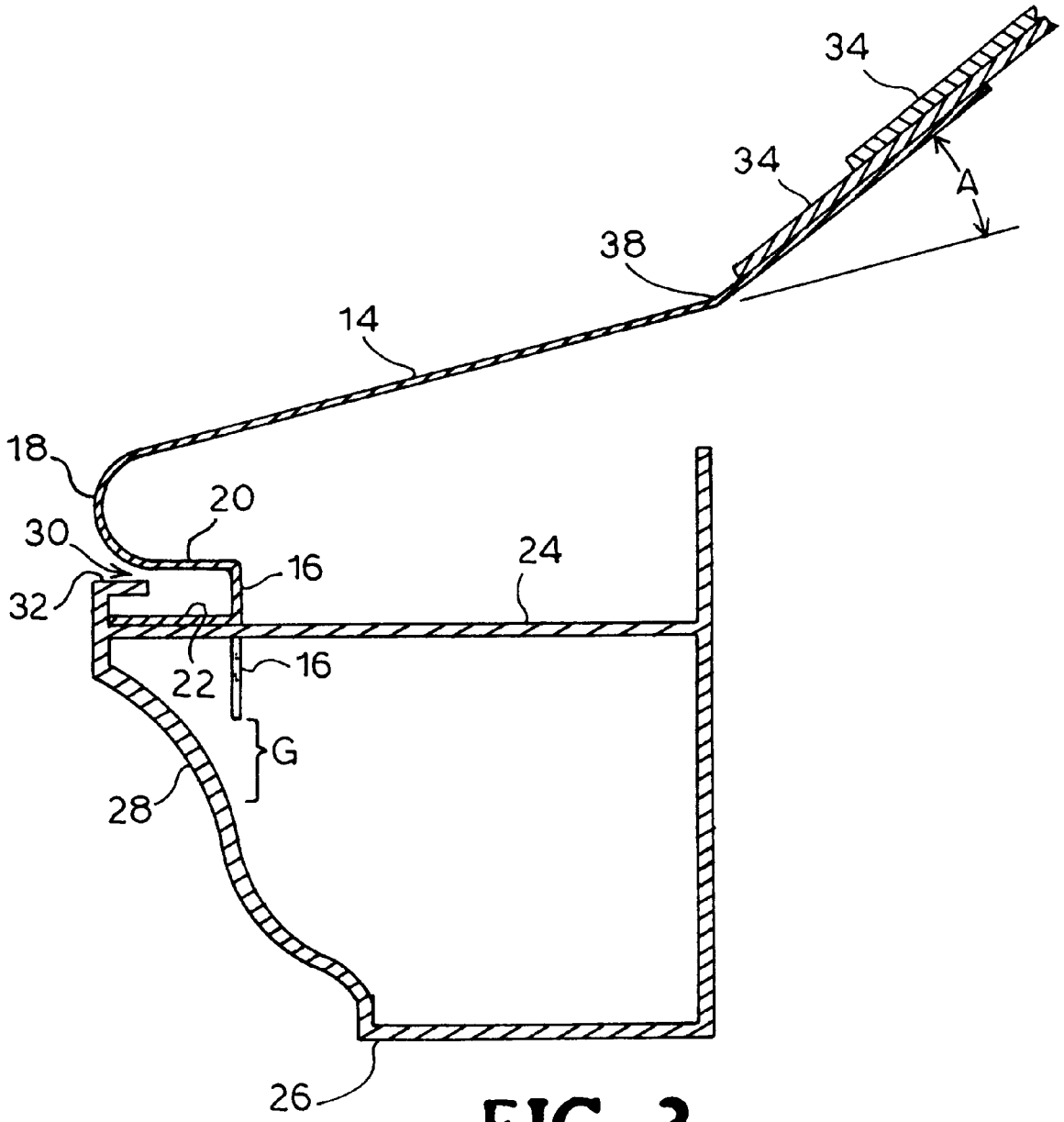
FIG. 3 is a cross-sectional view of the gutter cover of the invention shown at the position of one of the feet and a gutter cross-piece on which the foot rests and prevents wind uplift.

The front area 12 comprises an elongated leg portion 16 integral with and perpendicular to a lower horizontal strip 20 forming part of a curved front portion 18 as shown in FIG. 3. The elongated leg portion 16 extends vertically below the sheet at about a right angle to the lower horizontal portion 20, and both the elongated leg portion 16 and the curved front portion 18 extend the length of the sheet. The leg portion 16 is partially cut with sets of paired parallel cuts about 3-inches apart in the preferred embodiment, to form feet 22 as shown in FIGS. 1–4. Each of the feet 22 is spaced apart from adjacent feet 22 by an amount corresponding to the space between gutter cross-pieces 24 as are known in the art. As shown in FIG. 3, the feet 22 are bent upward and forward from the leg portion 16 so that when the cover 10 is placed on the rain gutter 26, the feet 22 hold the leg portion 16 of the gutter cover 10 back from the front side 28 of the gutter 26 so that there is a covered opening 30 over the gutter 26, with the front area 12 of the gutter cover 10 extending completely over the gutter 26 to keep out leaves but allowing capillary flow of water over the curved front portion 18, through the covered opening 30, and into the gutter 26.

Most preferably, the leg portion 16 extends "generally vertically" below the curved front portion 18 of the sheet as shown in FIG. 3, which means that the leg 16 forms an angle of about 90° from the plane of the lower horizontal strip 20 of the curved front portion 18 where the leg portion 16 is bent downward. The actual angle between the leg portion 16 and the curved front portion 18 is not critical, so long as the leg portion 16 is not so acutely bent forward so as to have the leg portion 16, and not just the feet 22, be in contact with the inside of the front side 28 of the gutter 26 and so long as the leg portion 16 is not angled backwards so far that the opening 30 between the gutter cover 10 and the gutter 26 is less than about 0.25–0.5 inch which would reduce or eliminate drainage of water into the gutter 26 from the gutter cover 10. In other words, the length and angle of projection of the leg portions 16 and feet 22 of the gutter cover 10 of the invention must allow for a sufficient gap between the front area 12 of the gutter cover 10 and the top of the gutter 26 for there to be capillary water drainage from the cover, and the dimensions can be adjusted accordingly for different styles of gutters and different angles and type of roof structures. It is believed that the leg-foot combination set forth above gives the invention particular uniqueness.

As used herein, the term "front" of the gutter cover 10 or the gutter 26 refers to portions of the particular item which extend or are located farthest out from the house and roof, so that having the leg portion 16 bent forward means that the lower edge of the leg portion 16 is closer to the front of the gutter cover 10 than is the back edge of the leg portion 16. The term "back" and related terms relate to portions closest to the roofing and house.

The gutter cover 10 when used on standard gutters having cross-pieces 24 and standard sloped roof structures has the leg portion 16 of the gutter cover 10 in the open top area of the gutter 26 so that the feet are aligned with and resting on the cross-pieces 24 and are beneath the front lip 32 of the gutter 26. This position holds the gutter cover 10 from wind uplift. In this position, there is a gap G of at least about ¼ inch between the lower edge of the leg portion 16 and the inside front of the gutter 26.

The gutter cover of the invention may be made by any manual or machining means known in the art. One preferred manual method for making the invention utilizes parallel sheets of metal, between which the edges of the sheet used to make the gutter cover may be inserted to bend the sheet the desired amount along the desired line, and a rounded piece, over which the sheet may be bent to form the curved front portion. Preferred dimensions for the individual pieces of the gutter cover, for a standard gutter having modular 3-foot sections, utilize sheets having a length of 37 inches to allow for overlap between adjacent gutter cover pieces and a width of 15 inches. The preferred leg portion 16 is about 1½ inches wide and the length of the sheet. The back planar area 14 extends for about 10 inches behind the curved front portion 18.

Figure 4:
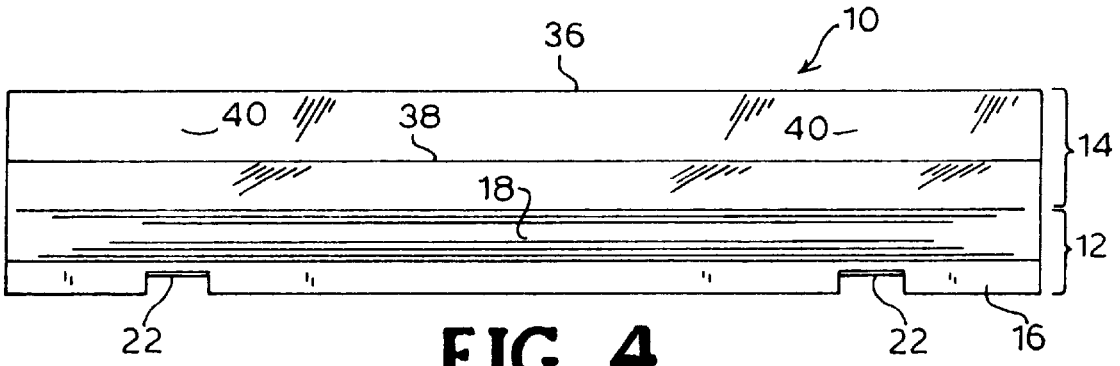
FIG. 4 is a front elevational view of the gutter cover of the invention.
Figure 5:
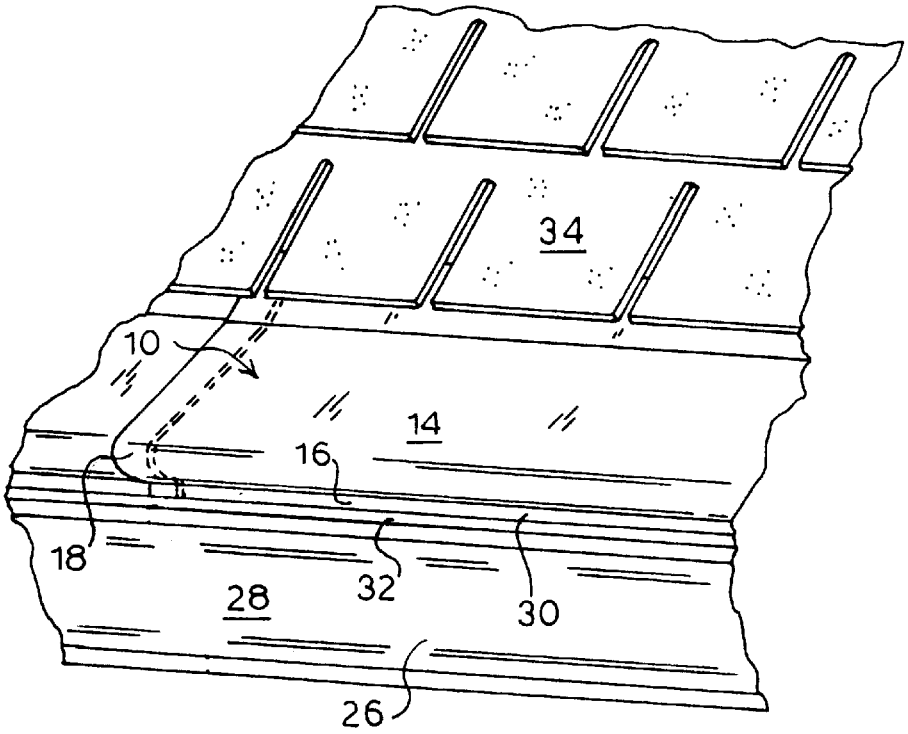
FIG. 5 is a perspective view of a gutter cover of the invention that has been installed on a gutter.

Installation of the gutter cover 10 on standard gutters and roof structures as shown in FIG. 5 includes positioning of each sheet of the gutter cover 10 with the front area 12 over the proper place on the gutter with respect to alignment of the gutter cross-pieces 24 and the feet 22, with the leg portions 16 above the gutter and then placing the back planar area 14 under a layer of shingles, preferably the second layer up, and fastening it down with fasteners as are known in the art at one or more selected areas 40 in the back planar area as shown for example in FIGS. 2 and 4. The shingles 34 cover fasteners and the back planar area 14, and the front area 12 of the gutter cover 10 is pushed down into the gutter 26 with a slight temporary bending sufficiently to position the feet 22 under the front lip 32 of the gutter 27. Adjacent sheets of the gutter cover 10 are positioned so that one of them slightly overlaps the other and curved portion 18 is flush with the front of front lip 32.

While the invention has been described with reference to specific embodiments, it will be appreciated that numerous variations, modifications, and embodiments are possible, and accordingly , all such variations, modifications, and embodiments are to be regarded as being within the spirit and scope of the invention.

What is claimed is:

1. A rain gutter cover comprising a plurality of single rectangular sheets of material, each of said sheets having a front area integrally connected to a back planar area, wherein the front area comprises a curved front portion having a lower horizontal strip; and an elongated leg portion integral with and perpendicular to the lower horizontal strip of the curved front portion and extending vertically below the sheet at about a right angle to the lower horizontal strip, said elongated vertical leg portion and said curved front portion extending the length of the sheet, wherein the bottom of the elongated vertical leg portion has a plurality of rectangular openings cut out of the leg portion along the bottom of the leg portion, each of said openings extending upward the same distance from the bottom of the leg portion, said distance being less than the full height of the vertical leg portion so that the openings each have an upper boundary on the vertical leg portion below the lower horizontal strip, said cover further comprising horizontal feet, each horizontal foot being the size of the rectangular opening below the foot and being positioned directly above the rectangular opening at the upper boundary of the opening, said curved front portion extending from the back planar area over the entire elongated vertical leg portion and over the horizontal feet.

2. The rain gutter cover of claim 1, wherein the front area and the back planar area are co-planar.

3. The rain gutter cover of claim 1, wherein the front area and the back planar area are at an obtuse angle to each other.

4. The rain gutter of claim 1, further comprising holes in the back planar area for attaching the cover beneath roofing.

5. The rain gutter of claim 1, wherein the feet are about three inches wide.

* * * * *